US010582750B2

(12) United States Patent
Siu

(10) Patent No.: US 10,582,750 B2
(45) Date of Patent: Mar. 10, 2020

(54) APPARATUS FOR HEATING HAIR ROLLERS

(71) Applicant: Conair Corporation, Stamford, CT (US)

(72) Inventor: Benny Kwan Shing Siu, Hong Kong (CN)

(73) Assignee: Conair Corporation, Stamford, CT (US)

( * ) Notice: Subject to any disclaimer, the term of this patent is extended or adjusted under 35 U.S.C. 154(b) by 348 days.

(21) Appl. No.: 15/457,414

(22) Filed: Mar. 13, 2017

(65) Prior Publication Data

US 2018/0255899 A1 Sep. 13, 2018

(51) Int. Cl.
*A45D 4/16* (2006.01)
*H05B 1/02* (2006.01)

(52) U.S. Cl.
CPC ..... *A45D 4/16* (2013.01); *H05B 1/0227* (2013.01)

(58) Field of Classification Search
CPC ... A45D 4/16; H05B 1/0288; H05B 2203/021
USPC ..... 219/388, 389, 521, 541, 385, 386; 132/227, 229, 237–238, 269; 221/120, 221/150 A, 277, 217; 432/124, 141; 312/266–269, 236; 211/164, 144, 131.2
See application file for complete search history.

(56) References Cited

U.S. PATENT DOCUMENTS 3,739,787 A * 6/1973 Keldmann ..... A45D 4/16 132/227
5,710,861 A * 1/1998 Stern ..... A45D 2/362 219/222
5,761,378 A 6/1998 Boyle et al.
5,896,864 A 4/1999 Boyle et al.
6,035,099 A 3/2000 Stern
6,084,210 A * 7/2000 Glucksman ..... A45D 4/16 132/229
6,248,979 B1 6/2001 Cafaro
6,310,322 B1 10/2001 Yang et al.
6,499,195 B1 12/2002 Wong
D477,689 S 7/2003 Hoffman et al.
6,732,745 B2 5/2004 Hester
D506,851 S 6/2005 Schmitz
D507,376 S 7/2005 Tobin
6,978,898 B2 12/2005 Carlucci et al.
7,078,654 B1 7/2006 Tsen
7,516,745 B2 4/2009 Maione et al.
(Continued)

FOREIGN PATENT DOCUMENTS

WO 201021968 A2 2/2010
WO 201310249 A1 1/2013

*Primary Examiner* — Dana Ross
*Assistant Examiner* — Joseph W Iskra
(74) *Attorney, Agent, or Firm* — Lawrence Cruz, Esq.; Ryan, Mason & Lewis, LLP

(57) ABSTRACT

An apparatus for sequentially and individually heating hair rollers incorporates a turn tray having a plurality of receptacles. The turn tray rotates, and if a roller is disposed in the receptacle, the turn tray will stop at a steam stage area where the roller is subjected to heat and steam. After a predetermined of time selected by the operator, e.g., when the hair roller is sufficiently treated with heat and steam, the roller is removed and applied to a length of hair of the operator. The turn tray will then automatically rotate to place the next successive roller within the steam stage area.

14 Claims, 7 Drawing Sheets

(56) References Cited

U.S. PATENT DOCUMENTS

| | | | | |
|---|---|---|---|---|
| D594,597 | S | | 6/2009 | Cardona |
| 7,989,735 | B1 | | 8/2011 | Richmond et al. |
| 8,258,434 | B2 | | 9/2012 | Richmond et al. |
| D683,500 | S | | 5/2013 | Cheung |
| D695,959 | S | * | 12/2013 | Shami ..... D28/38 |
| 8,684,012 | B1 | | 4/2014 | Ryan |
| 8,912,467 | B2 | | 12/2014 | Oishi et al. |
| 2004/0118425 | A1 | | 6/2004 | Santhouse et al. |
| 2005/0000954 | A1 | | 1/2005 | Schmitz |
| 2007/0257019 | A1 | | 11/2007 | Carlucci |
| 2008/0169278 | A1 | | 7/2008 | Kaizuka |
| 2008/0210255 | A1 | | 9/2008 | Moll |
| 2009/0133709 | A1 | | 5/2009 | Kaizuka |
| 2009/0165811 | A1 | | 7/2009 | Zimmerman |
| 2010/0065544 | A1 | | 3/2010 | Yang |
| 2016/0015142 | A1 | | 1/2016 | Wagner |

* cited by examiner

APPARATUS FOR HEATING HAIR ROLLERS

BACKGROUND

1. Technical Field

The present disclosure relates to personal care appliances. More particularly, the present disclosure relates to hair setting assemblies for holding and heating hair rollers.

2. Background of Related Art

Assemblies for heating hair curlers are well known. A typical hair setting assembly has a housing with a number of electrically heated vertical elements and a number of rollers, generally of different sizes, disposed on the vertical elements. The hair setting assembly typically includes a steam boiler heating system which simultaneously directs steam to each of the rollers.

However, these assemblies have a number of disadvantages which detract from their overall usefulness. Initially, all the rollers within the assembly are constantly subjected to steam and heat even when the operator is not ready to apply an individual roller to his/her hair, which is wasteful in terms of energy and steam output. Secondly, many assemblies include a lid to cover the rollers to retain heat. The lid may have a tendency to collect significant amounts of hot condensed water on the inner surface of the lid. When the lid is opened during the heating process, the condensed water may spill off the lid and onto the hands of a operator and the rollers, potentially burning the operator and damaging the rollers. In addition, should a significant amount of water condensation collect on the inner surface of the lid, the condensation can drip from the lid and into the electrical disclosure, thereby creating a shock hazard. These drawbacks are overcome in the hair setting assembly of the present disclosure.

SUMMARY

Accordingly, the present disclosure is directed to an apparatus for heating hair rollers or curlers in a sequential manner, e.g., one at a time, for presentation to the operator. The rollers are individually directed to a steam stage area, subjected to steam and heat, and then removed by the operator. Thereafter, a subsequent roller is automatically directed to the steam stage area and the process repeated. Multiple rollers of various sizes may be accommodated by the apparatus. The apparatus is devoid of a lid thereby avoiding many of the drawbacks of conventional assemblies.

In one embodiment, an apparatus for heating hair rollers includes a lower case defining a central longitudinal axis, a turn tray mounted relative to the lower case, and having a plurality of roller receptacles radially spaced with respect to the longitudinal axis for receiving hair rollers, a roller detection finger associated with each roller receptacle and being configured for movement from a radial outward position to a radial inward position upon positioning of a hair roller within the roller receptacle, a steam stage area including a steam outlet for dispensing steam, a motor operatively coupled to the turn tray and configured to rotate the turn tray about the longitudinal axis to selectively position a select roller receptacle adjacent the steam outlet, and a roller detection switch adjacent the steam stage area. The roller detection switch is configured to be operatively engaged by the roller detection finger of the select roller receptacle when in the radial inward position thereof. The roller detection switch is configured to stop rotational movement of the turn tray to maintain the select roller receptacle in the steam stage area and in alignment with the steam outlet to dispense steam toward the roller therewithin. Upon removal of the hair roller from the select roller receptacle within the steam stage area, the roller detection finger moves to the radial outward position disengaged from the roller detection switch to permit rotational movement of the turn tray about the longitudinal axis.

The roller detection switch may be configured for movement between a first position when engaged by the roller detection finger corresponding to a deactivated state of the motor and a second position when disengaged by the roller detection finger corresponding to an activated state of the motor.

The apparatus may include an upper case whereby the turn tray is rotatably mounted relative to the upper case. A tray detection switch is configured to permit activation of the motor when the turn tray is properly positioned relative to the upper case, and configured to deactivate the motor when the turn tray is displaced relative to the upper case.

The roller detection fingers may be normally biased radially outwardly to the radial outward position relative to the central longitudinal axis. Each roller detection finger may include a plurality of finger elements. A first finger element is configured to extend a first radial distance and a second finger element is configured to extend a second radial distance greater than the first radial distance. Each roller detection finger may include a third finger element configured to extend a third radial distance greater than the second radial distance and a fourth finger element configured to extend a fourth radial distance greater than the third radial distance. The differences in radial distances of the roller detection fingers accommodates different diameter rollers, and ensures that even small diameter rollers will move the roller detection finger to the radial inward position upon positioning of a roller within the roller receptacle.

The steam stage area may include a fluid tank in fluid communication with the steam outlet and a heater associated with the fluid tank to heat liquid in the fluid tank for disposition out the steam outlet.

Other features and advantages of the present disclosure will be better appreciated by the following description.

BRIEF DESCRIPTION OF THE DRAWINGS

Various aspects and features of the present disclosure are described hereinbelow with references to the drawings, wherein.

DETAILED DESCRIPTION

Figure 1:
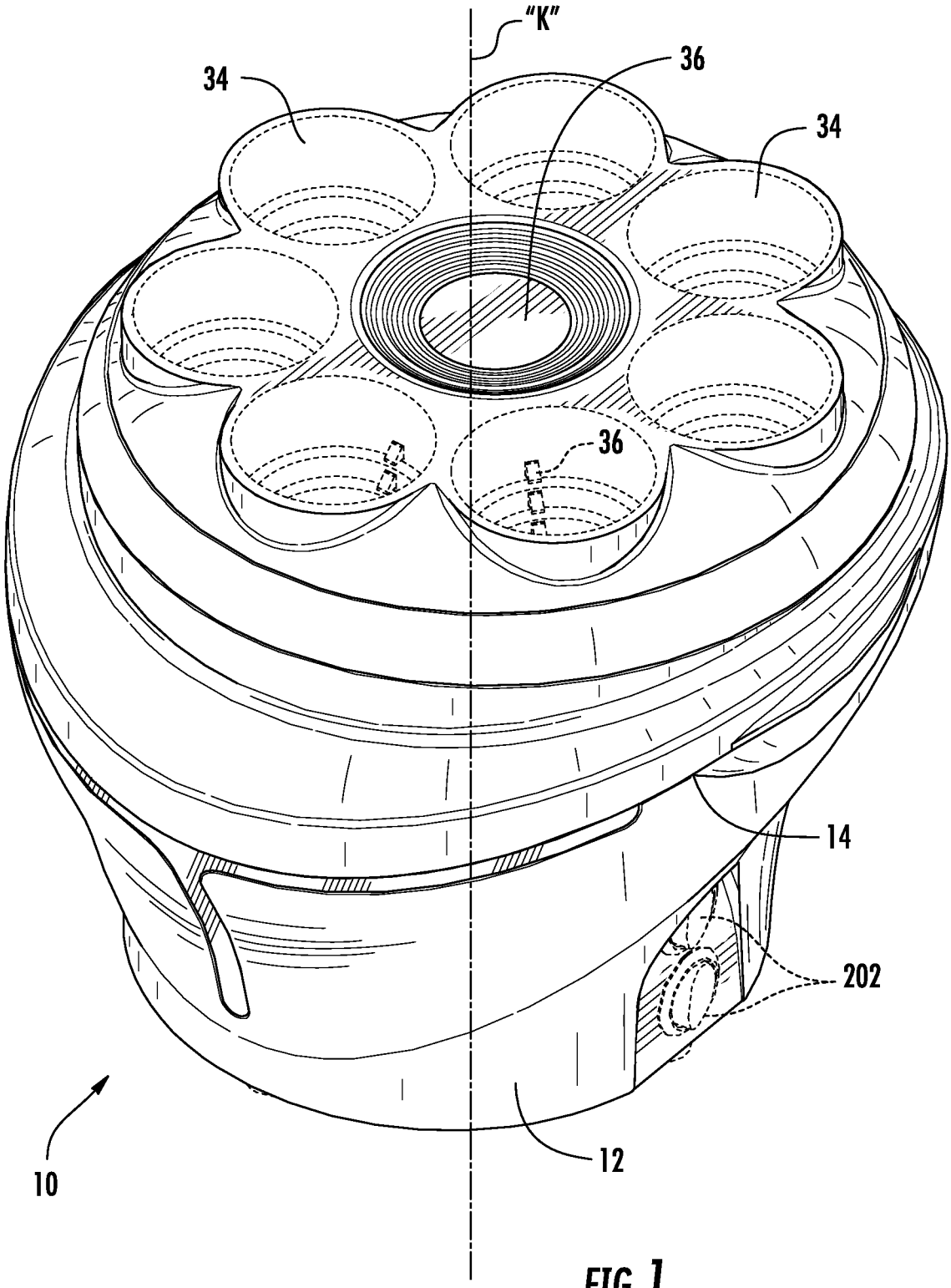
FIG. 1 is a perspective view of an apparatus for heating hair rollers in accordance with the principles of the present disclosure illustrating the lower case and the turn tray.
Figure 2:
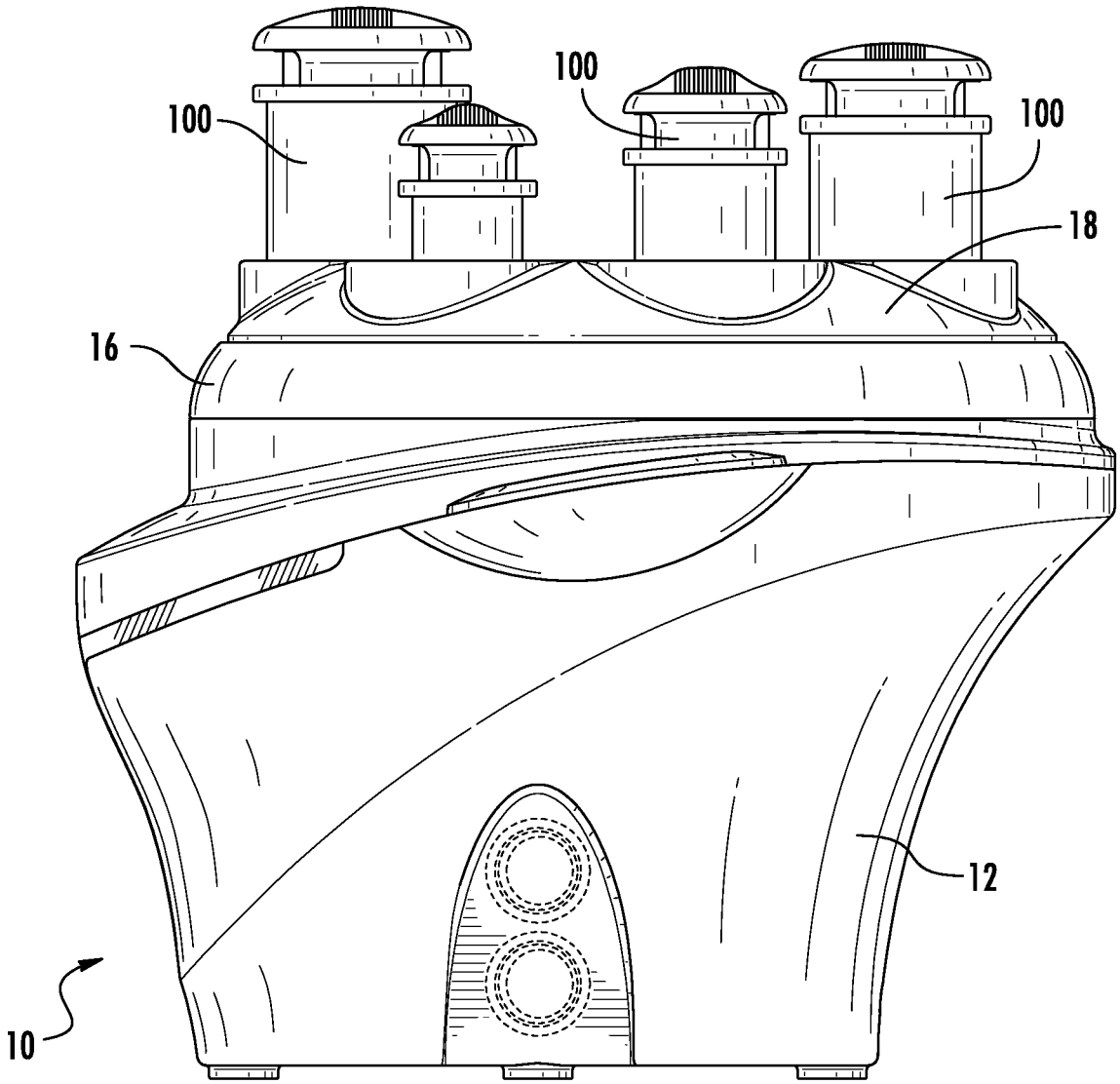
FIG. 2 is a side elevation view of the apparatus illustrating the turn tray holding a plurality of hair rollers of different sizes.

Particular embodiments of the present disclosure are described hereinbelow with reference to the accompanying drawings. However, it is to be understood that the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to employ the present disclosure in virtually any appropriately detailed structure.

The apparatus of the present disclosure will sequentially and individually heat hair rollers. In general, the apparatus incorporates a turn tray having a plurality of receptacles. The turn tray rotates, and if a roller is disposed in the receptacle, the turn tray will stop at a steam stage area where the roller is subjected to heat and steam. After a predetermined of time selected by the operator, e.g., when the hair roller is sufficiently treated with heat and steam, the roller is removed and applied to a length of hair of the operator. The turn tray will then automatically rotate to place the next successive roller within the steam stage area.

Referring now to FIGS. 1-4, the apparatus 10 for heating hair rollers in accordance with the principles of the present disclosure is illustrated. The apparatus 10 generally includes a lower case 12 defining a central longitudinal axis, an upper case 14, a cover 16 and a turn tray 18. The lower case 12 incorporates a number of electrical components, including, e.g., a turn tray detection pin and switch mechanism and a roller detection pin and switch mechanism to be discussed in greater detail hereinbelow. The lower case 12 further includes a motor 20 which operates the turn tray 18, i.e., rotates the turn tray 18 about the longitudinal axis "k". The motor 20 may be coupled to a tray clutch 22.

The upper case 14 includes a reservoir 24 which receives water and a heater 26 (FIG. 3) mounted adjacent the reservoir 24 for heating the water and converting the water to steam. Any conventional heater 26 may be utilized within the upper case 14 to create sufficient heat to emit steam. The upper case 14 includes an opening 28 (FIG. 3) configured to permit passage of the tray detection pin of the turn tray detection pin and switch mechanism as will be discussed. The upper case 14 further includes an opening 30 to permit passage of the drive shaft 20*a* of the motor 20 which in turn is coupled to the clutch 22 residing adjacent the top of the upper case 14 as shown in FIG. 4. Although shown as two components, the lower case 12 and the upper case 14 may be a single component monolithically or integrally formed.

The turn tray 18 is secured to a tray plate 32. The turn tray 18 and the tray plate 32 are, in one embodiment, secured relative to the cover 16, but are capable of rotational movement relative to the cover 16 about the longitudinal axis "k". In one embodiment, the cover 16, turn tray 18 and tray plate 32 are a subassembly whereby the subassembly is removably mounted relative to the upper case 14. Other arrangements are also envisioned. The turn tray 18 includes a plurality of roller receptacles 34 configured to receive hair rollers 100 of different sizes. Each receptacle 34 has a roller detection finger mechanism therein capable of detecting the presence of a roller 100 within a specific receptacle 34. The function and operation of the roller detection finger mechanism will be discussed in detail hereinbelow. The turn tray 18 further includes a central receptacle 36 for accommodating ancillary components such as a sponge, pins, etc.

Figure 3:
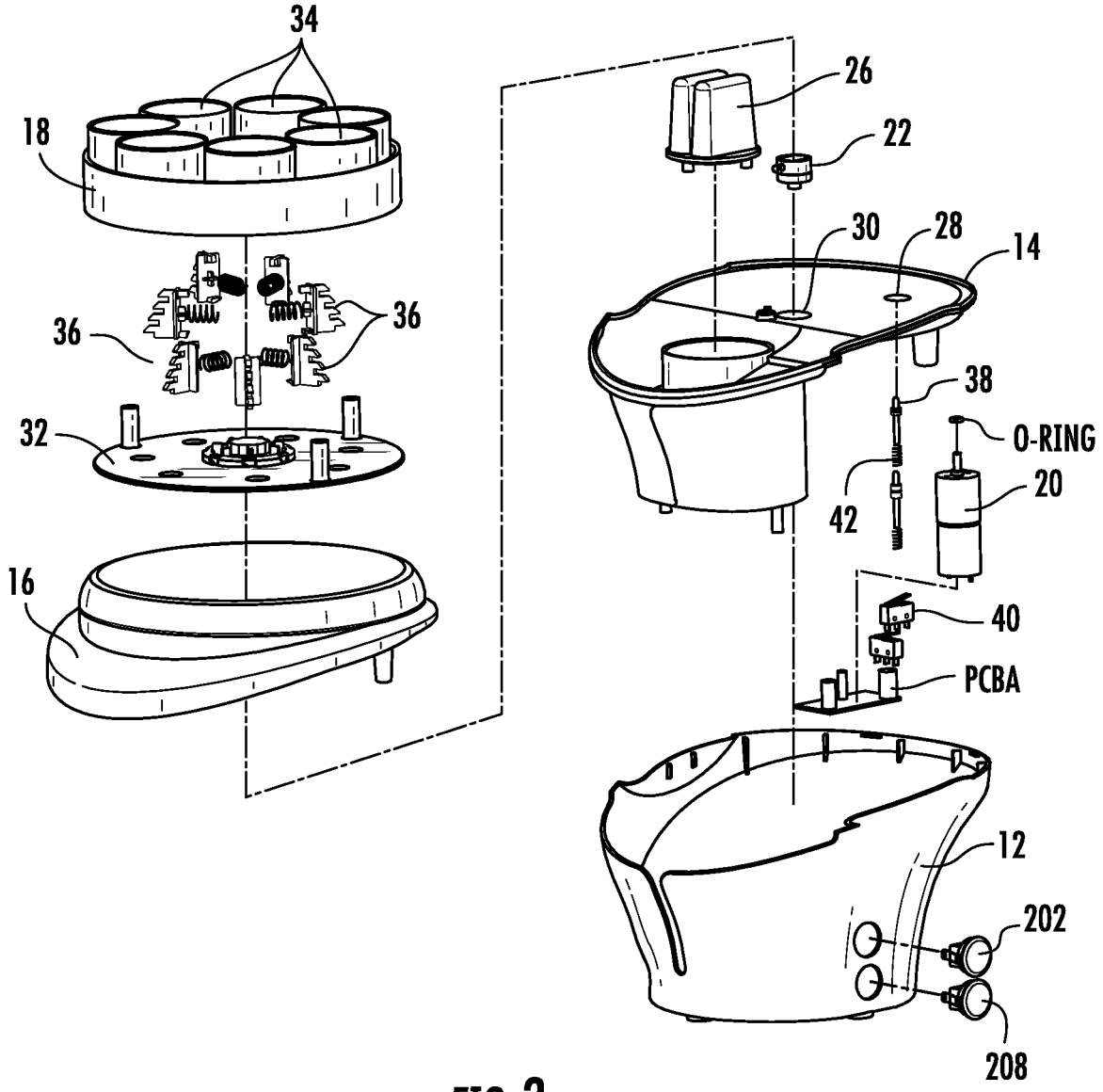
FIG. 3 is an exploded perspective view of the apparatus illustrating the internal components.
Figure 4:
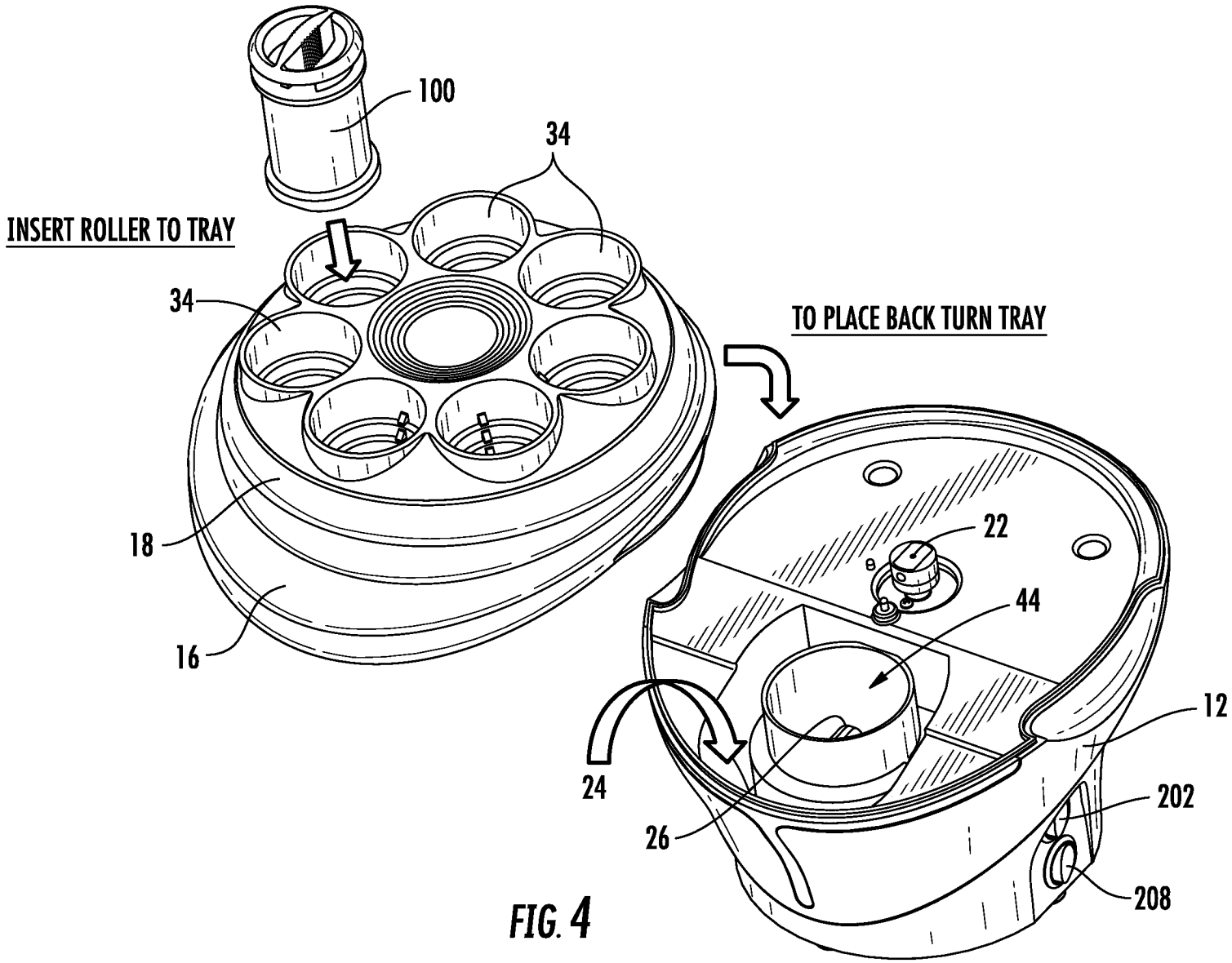
FIG. 4 is a perspective view illustrating the cover and turn tray removed from the lower case of the apparatus.
Figure 6:
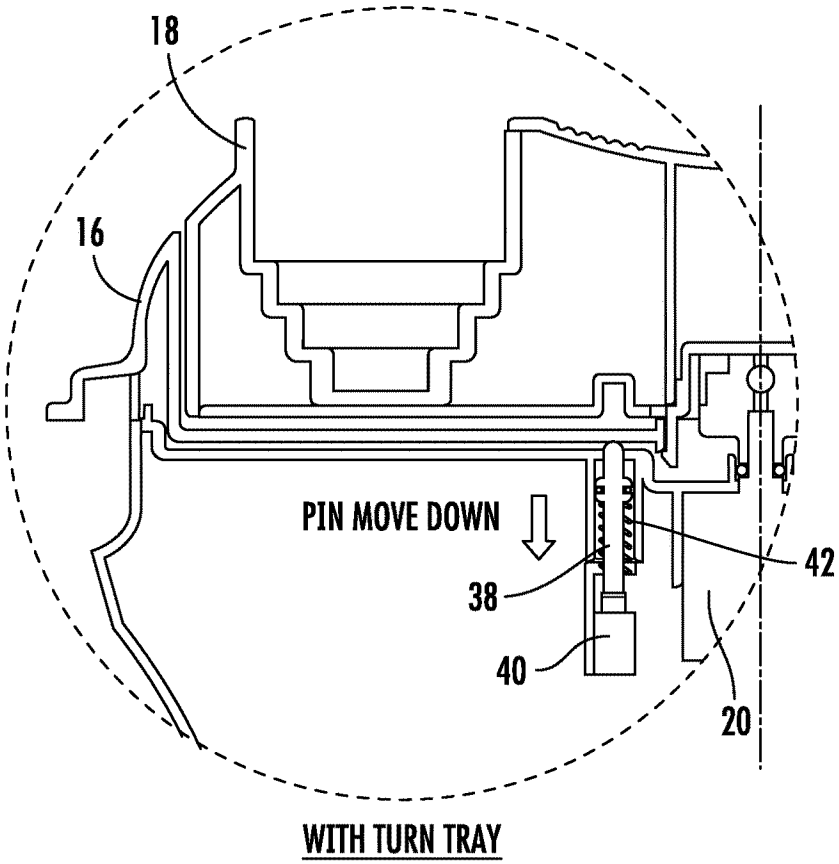
FIGS. 5-6 are isolated views illustrating the tray detection pin in an unactivated position and an activated position respectively corresponding to the release and mounted conditions of the cover and the turn tray relative to the lower case of the apparatus.
Figure 5:
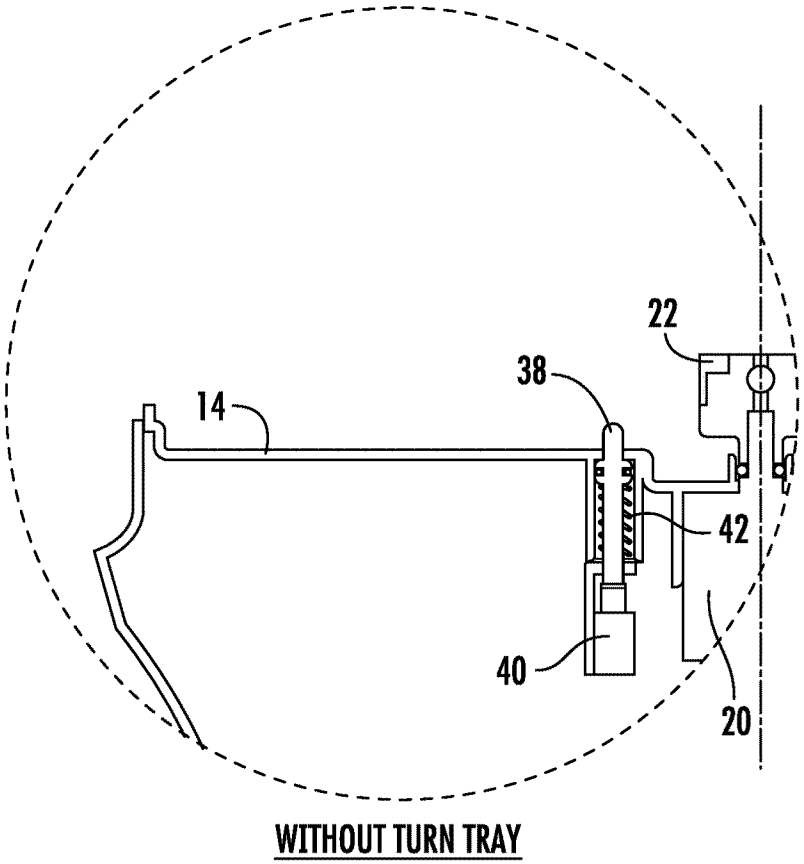

Referring now to FIGS. 3 and 5-6, the turn tray detection pin and switch mechanism will be discussed. The turn tray detection pin and switch mechanism includes a detection pin 38 and a tray detection switch 40 disposed beneath the detection pin 38. The detection pin 38 extends through the opening 28 in the upper case 14 and is normally biased to the upward position depicted in FIG. 5 by a coil spring 42. In FIG. 5, the subassembly of the cover 16, turn tray 18 and the tray plate 32 are removed from the upper case 14. Upon proper mounting of the subassembly onto the upper case 14 and/or the lower case 12 as depicted in FIG. 6, the cover 16 engages the detection pin 38 to displace it in a downward direction to thereby engage and activate the tray detection switch 40. If the subassembly is removed or improperly positioned relative to the upper case 14 and/or the lower case 12, the detection pin 38 will not be engaged by the cover 16 and the tray detection switch 40 will remain open and deactivated. Thus, the turn tray detection pin and switch mechanism will deactivate the motor 20 in the event the turn tray 18 is not properly mounted relative to the upper case 14 and/or the lower case 12. In the alternative, either the tray plate 32 or the turn tray 18 may be configured to engage and displace the detection pin 38 to activate/deactivate the tray detection switch 40.

Figure 8:
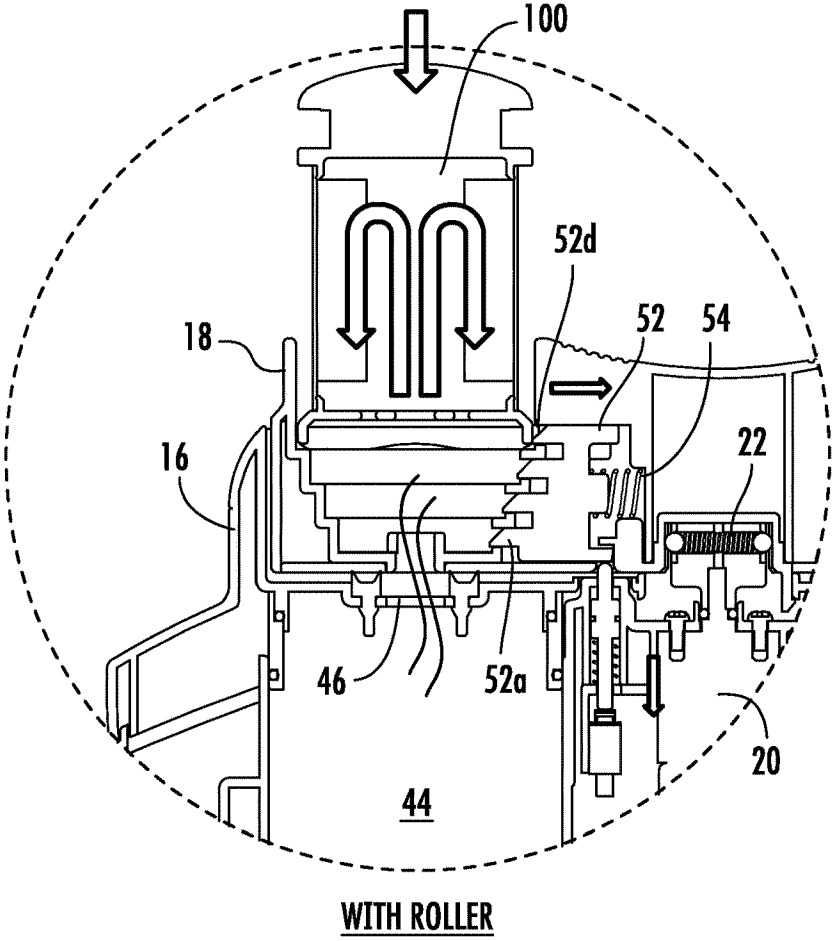
FIG. 8 is an isolated view similar to the view of FIG. 7 illustrating the roller finger in a radial inward position in the presence of a hair roller within the roller receptacle.
Figure 7:
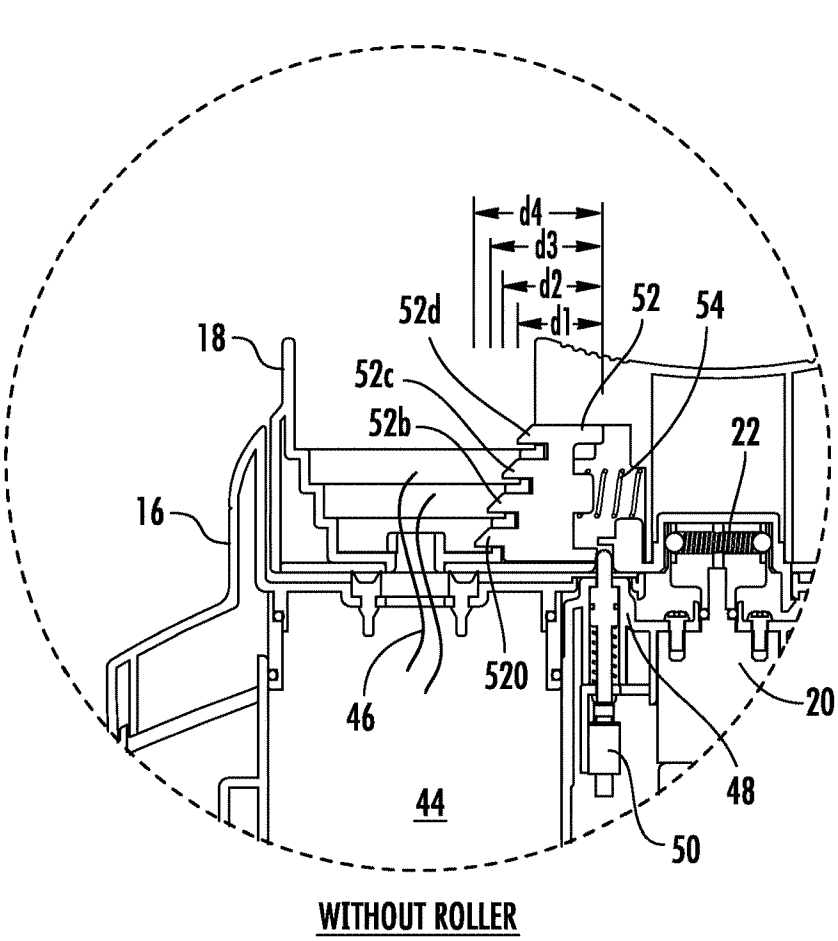
FIG. 7 is an isolated view illustrating the roller finger of a roller receptacle in a radial outward position in the absence of a hair roller within the roller receptacle.

Referring now to FIGS. 7-8, the roller detection mechanism will be discussed. The roller detection switch mechanism is disposed within a steam stage area 44 of the lower case 12 (FIG. 4) adjacent the heater 26 and the reservoir 24. The cover 16 defines an opening forming a steam outlet 46 which is in fluid communication with the heated water reservoir 24. The roller detection switch mechanism includes a detection pin 48 and a roller detection switch 50 which is normally closed to maintain operation of the motor 20. The roller detection mechanism further includes a roller detection finger 52 disposed within each roller receptacle 34. The roller detection fingers 52 are each mounted for movement between a radial outward position and a radial inward position, and are each normally biased to the radial outward position by a coil spring 54. In the absence of a roller 100 as depicted in FIG. 7, the roller detection finger 52 is in its normally outwardly biased position under the influence of coil spring 54. Thus, the roller detection finger 52 is displaced relative to the detection pin 48. When a roller 100 is positioned within the roller receptacle 34 as depicted in FIG. 8, the roller detection finger 52 is engaged by the roller 100 and moves radially inwardly toward the central longitudinal axis "k". During this inward movement, the lower cam surface 56 of the roller detection finger 52 engages the detection pin 48 and displaces the detection pin 48 in a downward direction thereby placing the roller detection switch 50 in an open condition. In the open condition, the motor 20 is deactivated; thus, the roller 100 is maintained in the steam stage area 44 to be subjected by the steam emitted through the steam outlet 46. After a predetermined period of time selected by the operator, the roller 100 may be removed by the operator, which causes the roller detection finger 52 to return to its outward condition under the bias of coil spring 54. In this position, the roller detection switch 50 returns to its closed condition activating the motor 20 to cause rotation of the turn tray 18. The turn tray 18 will continue to rotate until it is engaged by a subsequent roller detection finger 52 if the roller detection finger 52 is in it radial inward position due to the presence of a roller 100 within a successive receptacle 34.

Thus, if a roller 100 is present in a roller receptacle 34 and the turn tray 18 rotates to position the roller 100 in the steam stage area 44, the roller detection finger 52 which is in its radial inward position will displace the detection pin 48 and deactivate the motor 20. The roller 100 will be subjected to the steam as depicted in FIG. 8 until the operator removes the roller 100. Removal of the roller 100 causes the detection pin 48 to move to its upward position activating the motor 20 to cause rotation of the turn tray 18. The turn tray 18 will continue to rotate until a roller receptacle 34 containing a roller 100 enters the steam stage area 44 to cause deactivation of the motor 20. If a successive roller receptacle 34 is devoid of a roller, the turn tray 18 continues to rotate through the steam stage area 44.

With continued reference to FIGS. 7-8, each roller detection finger includes a plurality of finger elements 52*a*, 52*b*, 52*c*, 52*d*. The finger elements 52*a*, 52*b*, 52*c*, 52*d* extend respective first, second, third and fourth radial distances "d1", "d2", "d3", "d4" with each distance increasing in length. The different radial distances "d1", "d2", "d3", "d4", ensure that regardless of the diameter of the roller 100 positioned in the roller receptacle 34, the roller detection finger 52 will be engaged and moved radially inwardly to engage the detection pin 48. For example, a smaller diameter roller 100 will at least engage finger element 52*a* to move the roller detection finger 52 in a radial inward direction to engage the detection pin 48.

Figure 9:
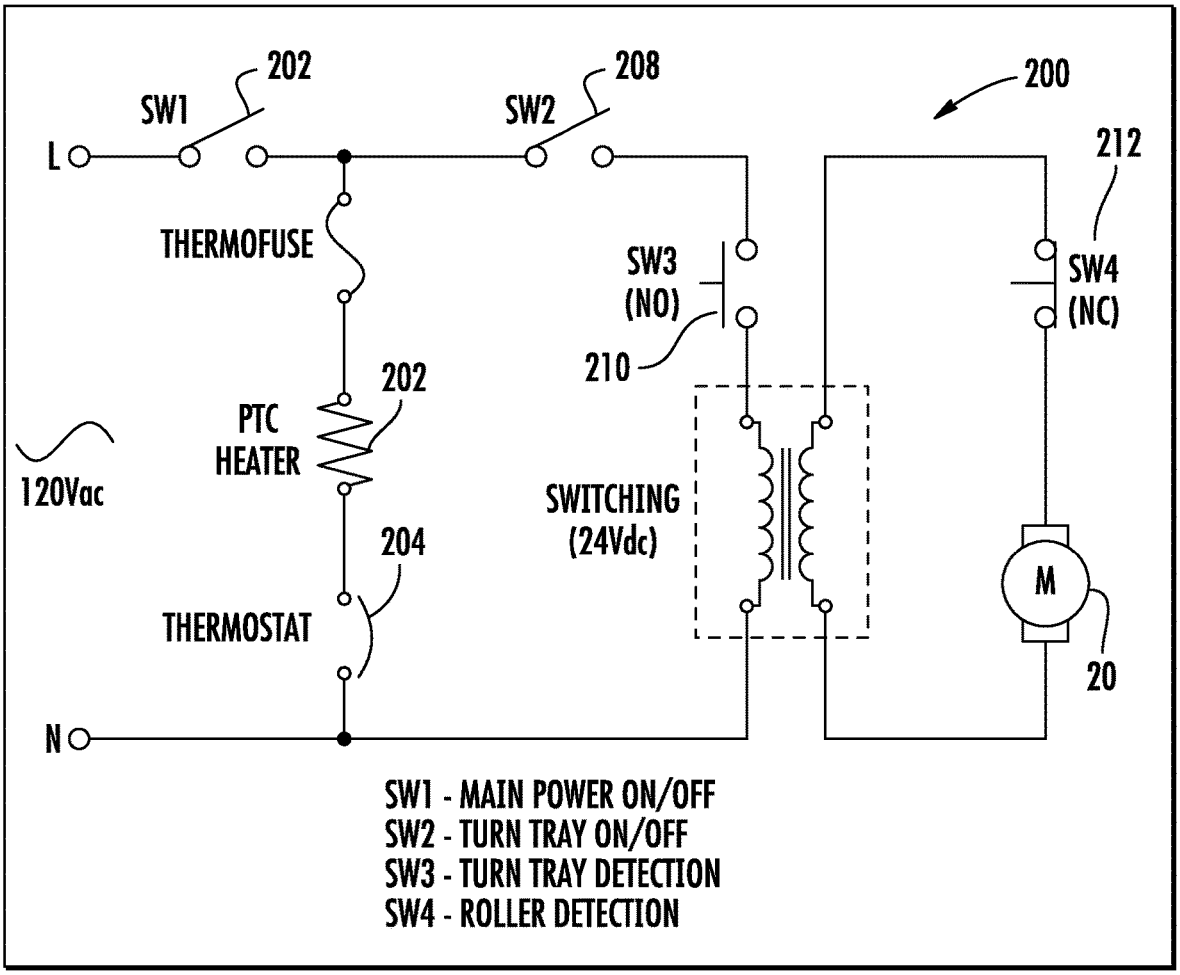
FIG. 9 is a schematic diagram of the electrical components of the apparatus.

FIG. 9 is a circuit diagram of the apparatus 10. The circuit 200 includes a power on/off switch 202 (FIG. 1) which activates at least the heater 204 (corresponding to heater 20) controlled by a thermostat 206. The circuit 200 also includes a turn tray switch 208 (FIG. 1) for activating rotation of the turn tray 18. The turn tray switch 208 is in series with the tray detection switch 210 (corresponding to tray detection switch 40) which is normally in the open position until the cover 16 and the turn tray 18 are properly mounted to the lower case 12, in which case, the detection pin 38 activates the tray detection switch 210 to enable rotation of the turn tray 18. The circuit 200 further includes a roller detection switch 212 (corresponding to roller detection switch 50) which is in series with the motor 20. The roller detection switch 212 is normally closed to permit operation of the motor 20 and rotation of the turn tray 18. However, in the presence of a roller 100 within the roller receptacle 34, the roller detection switch 212 is deactivated (open) to stop operation of the motor 20 and stop rotation of the turn tray 18 to permit the roller 100 to be heated within the steam stage area 44. The circuit 200 also may include a standard AC/DC transformer 214.

While several embodiments of the disclosure have been shown in the drawings and described herein, it is not intended that the disclosure be limited thereto, as it is intended that the disclosure be as broad in scope as the art will allow and that the specification be read likewise. Therefore, the above description should not be construed as limiting, but merely as examples of particular embodiments. Those skilled in the art will envision other modifications within the scope and spirit of the claims appended hereto.

What is claimed is:

1. An apparatus for heating hair rollers, which comprises:

a lower case defining a central longitudinal axis;

a turn tray mounted relative to lower case, the turn tray including a plurality of roller receptacles radially spaced with respect to the longitudinal axis for receiving hair rollers;

an upper case, the turn tray rotatably relative to the upper case;

a roller detection finger associated with each roller receptacle, each roller detection finger configured for movement from a radial outward position to a radial inward position upon positioning of a hair roller within the roller receptacle;

a tray detection switch configured to permit activation of the motor when the tray is properly positioned relative to the upper case and configured to deactivate the motor when the tray is displaced relative to the upper case;

a steam stage area including a steam outlet for dispensing steam;

a motor operatively coupled to the turn tray and configured to rotate the turn tray about the longitudinal axis to selectively position a select roller receptacle adjacent the steam outlet; and a roller detection switch adjacent the steam stage area and being configured to be engaged by the roller detection finger of the select roller receptacle when in the radial inward position thereof, the roller detection switch configured to stop rotational movement of the turn tray to maintain the select roller receptacle in the steam stage area and in alignment with the steam outlet to dispense steam toward the roller therewithin, wherein upon removal of the hair roller from the select roller receptacle the roller detection finger moves to the radial outward position disengaged from the roller detection switch to permit rotational movement of the turn tray about the longitudinal axis.

2. The apparatus according to claim 1 wherein the roller detection switch is configured for movement between a first position when engaged by the roller detection finger corresponding to a deactivated state of the motor and a second position when disengaged by the roller detection finger corresponding to an activated state of the motor.

3. The apparatus according to claim 1 wherein the roller detection fingers are normally biased radially outwardly relative to the central longitudinal axis.

4. An apparatus for heating hair rollers, which comprises:

a lower case defining a central longitudinal axis;

a turn tray mounted relative to lower case, the turn tray including a plurality of roller receptacles radially spaced with respect to the longitudinal axis for receiving hair rollers;

a roller detection finger associated with each roller receptacle, each roller detection finger configured for movement from a radial outward position to a radial inward position upon positioning of a hair roller within the roller receptacle, the roller detection fingers being normally biased radially outwardly toward the radial outward position thereof, each roller detection finger including a plurality of finger elements, a first finger element configured to extend a first radial distance and a second finger element configured to extend a second radial distance greater than the first radial distance;

a steam stage area including a steam outlet for dispensing steam;

a motor operatively coupled to the turn tray and configured to rotate the turn tray about the longitudinal axis to selectively position a select roller receptacle adjacent the steam outlet; and a roller detection switch adjacent the steam stage area and being configured to be engaged by the roller detection finger of the select roller receptacle when in the radial inward position thereof, the roller detection switch configured to stop rotational movement of the turn tray to maintain the select roller receptacle in the steam stage area and in alignment with the steam outlet to dispense steam toward the roller therewithin, wherein upon removal of the hair roller from the select roller receptacle the roller detection finger moves to the radial outward position disengaged from the roller detection switch to permit rotational movement of the turn tray about the longitudinal axis.

5. The apparatus according to claim 4 wherein each roller detection finger includes a third finger element configured to extend a third radial distance greater than the second radial distance and a fourth finger element configured to extend a fourth radial distance greater than the third radial distance.

6. The apparatus according to claim 1 wherein the steam stage area includes a fluid tank in fluid communication with the steam outlet and a heater associated with the fluid tank to heat liquid in the fluid tank for disposition out the steam outlet.

7. The apparatus according to claim 4 including:

an upper case, the turn tray rotatably relative to the upper case.

8. The apparatus according to claim 7 including:

a tray detection switch configured to permit activation of the motor when the tray is properly positioned relative to the upper case and configured to deactivate the motor when the tray is displaced relative to the upper case.

9. An apparatus for heating hair rollers, which comprises:

a lower case defining a central longitudinal axis;

a turn tray mounted relative to lower case, the turn tray including a plurality of roller receptacles radially spaced with respect to the longitudinal axis for receiving hair rollers;

an upper case, the turn tray rotatably relative to the upper case;

a roller detection finger associated with each roller receptacle, each roller detection finger configured for movement from a radial outward position to a radial inward position upon positioning of a hair roller within the roller receptacle;

a tray detection switch configured to permit activation of the motor when the tray is properly positioned relative to the upper case and configured to deactivate the motor when the tray is displaced relative to the upper case;

a steam stage area including a steam outlet for dispensing steam;

a motor operatively coupled to the turn tray and configured to rotate the turn tray about the longitudinal axis to selectively position a select roller receptacle adjacent the steam outlet;

a roller detection switch configured to be engaged by the roller detection finger of the select roller receptacle when in the radial inward position thereof, the roller detection switch configured to stop rotational movement of the turn tray to maintain the select roller receptacle in the steam stage area and in alignment with the steam outlet to dispense steam toward the roller therewithin wherein upon removal of the hair roller from the select roller receptacle the roller detection finger moves to the radial outward position disengaged from the roller detection switch to permit rotational movement of the turn tray about the longitudinal axis.

10. The apparatus according to claim 9 wherein the roller detection switch is disposed adjacent the steam stage area.

11. The apparatus according to claim 9 wherein the roller detection switch is configured for movement between a first position when engaged by the roller detection finger corresponding to a deactivated state of the motor and a second position when disengaged by the roller detection finger corresponding to an activated state of the motor.

12. The apparatus according to claim 9 including an upper case, the turn tray rotatably relative to the upper case.

13. The apparatus according to claim 9 wherein the roller detection fingers are normally biased radially outwardly toward the radial outward position.

14. The apparatus according to claim 9 wherein the steam stage area includes a fluid tank in fluid communication with the steam outlet and a heater associated with the fluid tank to heat liquid in the fluid tank for disposition out the steam outlet.

* * * * *